US006126407A

United States Patent [19]

Guentert et al.

[11] Patent Number: 6,126,407

[45] Date of Patent: Oct. 3, 2000

[54] PUMP DEVICE FOR HIGH PRESSURE FUEL DELIVERY IN FUEL INJECTION SYSTEM OF INTERNAL COMBUSTION ENGINES

[75] Inventors: Josef Guentert, Gerlingen; Bernd Streicher, Filderstadt; Uwe Kuhn, Riederich; Juergen Hammer, Fellbach, all of Germany; Thomas Lettner, Hallein, Austria

[73] Assignee: Robert Bosch GmbH, Stuttgart, Germany

[21] Appl. No.: 09/284,773

[22] PCT Filed: Jul. 9, 1998

[86] PCT No.: PCT/DE98/01919

§ 371 Date: May 28, 1999

§ 102(e) Date: May 28, 1999

[87] PCT Pub. No.: WO99/09316

PCT Pub. Date: Feb. 25, 1999

[30] Foreign Application Priority Data

Aug. 20, 1997 [DE] Germany ..... 197 36 160

[51] Int. Cl.[7] ..... H05B 1/00; H05B 3/02

[52] U.S. Cl. ..... 417/244; 417/273; 123/198 DB; 123/299

[58] Field of Search ..... 123/501, 504, 123/450, 300, 299, 198 DB, 514, 495; 417/244, 366, 273, 206

[56] References Cited

U.S. PATENT DOCUMENTS

| | | | |
|---|---|---|---|
| 3,824,975 | 7/1974 | Bastow | 123/504 |
| 4,425,896 | 1/1984 | Murayama | 123/501 |
| 4,455,125 | 6/1984 | Irwin | 417/244 |
| 4,517,946 | 5/1985 | Takano et al. | 123/450 |
| 4,951,626 | 8/1990 | Haag et al. | 123/300 |
| 5,233,955 | 8/1993 | Kraemer et al. | 123/299 |
| 5,354,183 | 10/1994 | Eisenbacher et al. | 417/366 |
| 5,571,243 | 11/1996 | Arnold et al. | 123/198 DB |
| 5,626,121 | 5/1997 | Kushida et al. | 123/514 |
| 5,630,708 | 5/1997 | Kushida et al. | 417/273 |
| 5,641,274 | 6/1997 | Kubo et al. | 417/206 |
| 5,967,123 | 10/1999 | Ruoff et al. | D123/495 |

*Primary Examiner*—Teresa Walberg
*Assistant Examiner*—Leonid Fastovsky
*Attorney, Agent, or Firm*—Ronald E. Greigg; Edwin E. Greigg

[57] ABSTRACT

The invention relates to a pump device for high-pressure fuel delivery in fuel injection systems of internal combustion engines, in particular in a common rail injection system, including a radial piston pump (2, 68, 80) with a drive shaft (38, 74, 114) that is supported in a pump housing (14) and is embodied eccentrically or has cam-like projections in the circumference direction, preferably with a number of pistons that are each disposed in a cylinder chamber radially in relation to the drive shaft and can be driven to reciprocate in the cylinder chamber when the drive shaft rotates, and with a check valve on the intake side and the high pressure side, and a low pressure pump (4, 71, 82) connected before the radial piston pump; in order to improve the pump device in such a way that it is more compact and can be produced more cheaply and the danger of the occurrence of leaks is reduced, the low pressure pump (4, 71, 82) is provided on or in the pump housing (14) of the radial piston pump (2, 68, 80), on the end remote from the drive end (10), and can be driven by the drive shaft (38, 74, 114) of the radial piston pump. (FIG. 1*b*)

23 Claims, 5 Drawing Sheets

Fig. 1a
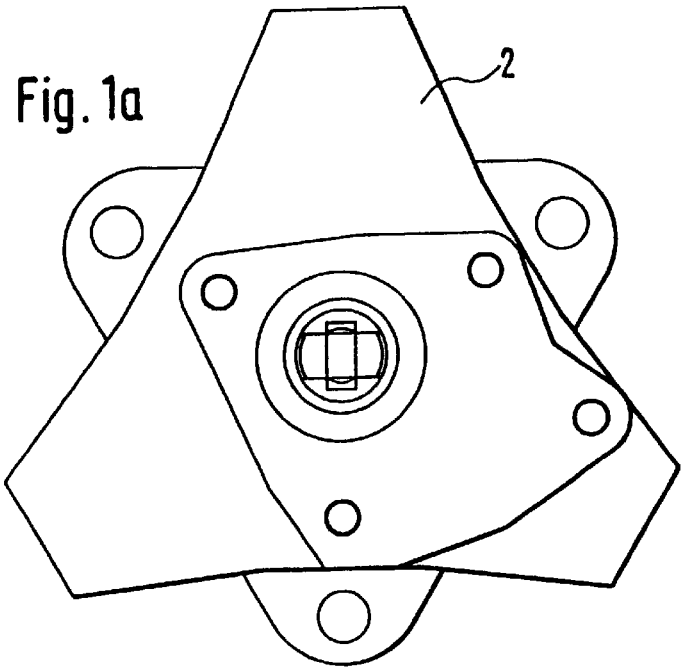
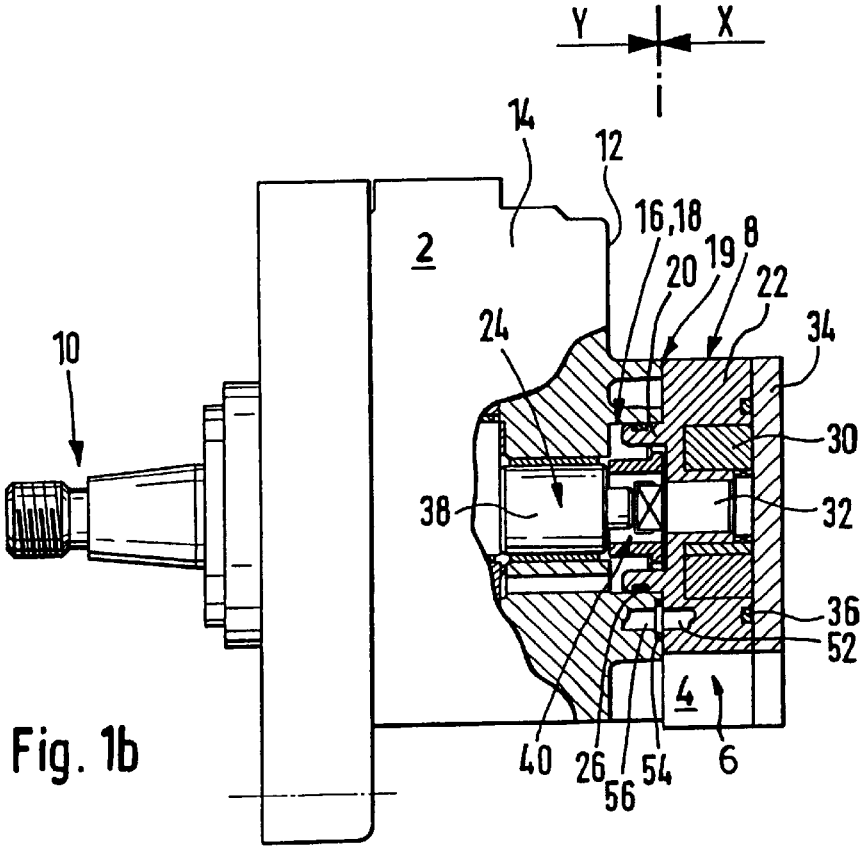
Fig. 1b

PUMP DEVICE FOR HIGH PRESSURE FUEL DELIVERY IN FUEL INJECTION SYSTEM OF INTERNAL COMBUSTION ENGINES

PRIOR ART

The invention relates to a pump device for high pressure fuel delivery in fuel injection systems of internal combustion engines, in particular in a common rail injection system, including a radial piston pump with a drive shaft that is supported in a pump housing and is embodied eccentrically or has cam-like projections in the circumference direction. Preferably a number of pistons are disposed in a cylinder chamber radially in relation to the drive shaft and can be driven to reciprocate in the cylinder chamber when the drive shaft rotates, and includes a check valve on the intake side and the high pressure side, and a low pressure pump connected before the radial piston pump.

The supply of fuel to the radial piston pump, which produces the high pressure takes place in a known manner by means of a low pressure pump as the pre-feed pump.

In known pump devices, the low pressure pump is disposed spatially separate from the radial piston pump. The low pressure pump is usually embodied as a separate pump and is driven by a shaft of the internal combustion engine or it is embodied as an electric pump.

In order to accommodate two pumps that are spatially separate from each other, a corresponding space is required, and additional fastening points must be produced for the pump housing. In addition, it requires additional fuel lines in order to connect the low pressure pump to the radial piston pump. As a result, there is an increased danger that leaks will occur.

Based on this, the object of the current invention is to produce a pump device of the type described at the beginning in which the above-explained disadvantages do not occur. In particular, a compact pump device should be produced that saves space and is inexpensive to produce.

This object is attained according to the invention by means of a pump device of the type mentioned at the beginning by virtue of the fact that the low pressure pump on or in the pump housing of the radial piston pump is provided on the end remote from the drive end and can be driven by the drive shaft of the radial piston pump.

This reduces the number and length of the fuel-carrying lines outside the pump housing and thus reduces the danger that external leaks will occur. Furthermore, a very compact construction of the pump device can be achieved. Because of the savings in housing parts and the realization of a common drive train, the pump can also be produced more cheaply.

In a preferred manner, a coupling is interposed between the drive shaft of the radial piston pump and a shaft of the low pressure pump. As a result, assembly or manufacture precision of the components of the radial piston pump and the low pressure pump, in particular flush deviations of the drive shaft of the radial piston pump and the shaft or of a corresponding shoulder in the low pressure pump can be compensated for.

The use of an Oldham coupling has turned out to be suitable, particularly in the embodiment of the low pressure pump as a gear pump that is relatively flat in structure.

In a particularly preferred manner, the housing of the low pressure pump is embodied as essentially disk-shaped, which is why a gear pump has turned out to be particularly suitable.

The housing of the low pressure pump preferably can be mounted to the pump housing of the radial piston pump by way of a centering means. To this end, it turns out to be advantageous if a centering flange that protrudes in the direction of the housing of the low pressure pump is provided on the pump housing of the radial piston pump, with which flange the housing of the low pressure pump can be positioned. It goes without saying that a converse embodiment of the centering flange on the housing of the low pressure pump is also included in this concept of the invention.

In order to seal the low pressure pump and the radial piston pump in relation to the outside, it has turned out to be sufficient and advantageous to provide an elastomer sealing means that is advantageously disposed between the centering flange of the radial piston pump and the housing or an opposing flange or collar of the low pressure pump.

In order to define the static contact of the two pumps against each other, it has turned out to be advantageous if the centering flange is supported with its end face against a flat end face of the housing of the low pressure pump.

However, it is also possible that the radial piston pump and the low pressure pump are supported with flat end faces against each other. In such an instance, centering means can be embodied, preferably in the form of a number of alignment bores and alignment pins that engage in them or can also be embodied by threaded bores and alignment screws that are screwed into them.

The front side of the low pressure pump could lead in an intrinsically arbitrary manner to the intake side of the radial piston pump, for example a relatively short external line section could be provided. However, an embodiment is preferable in which a fuel supply conduit leads away from a pressure chamber of the low pressure pump and communicates with a fuel intake opening in the pump housing of the radial piston pump, i.e. the openings in the housing components resting against each other feed into one another in a flush manner.

Depending on whether the radial piston pump is fuel-lubricated or is lubricated by the lubricating oil circuit of the engine, it turns out to be advantageous if, in the region of the drive train, an additional sealing means for preventing leakage from the low pressure pump into the pump housing of the radial piston pump can be dispensed with or is advantageously provided in order to prevent a leakage of this kind in the latter instance. If in the latter instance, an additional sealing element is provided, then it furthermore turns out to be advantageous if there is a communication between the shaft region of the low pressure pump and the suction chamber in order to remove the emerging leakage liquid and supply it to the intake side of the radial piston pump.

It should furthermore be mentioned that it turns out to be particularly advantageous if the radial piston pump has a solid, monoblock-like component in which bores are provided that constitute the cylinder chambers for the pistons as well as all of the fuel intake openings and high pressure-carrying supply openings. The low pressure pump can then be attached directly to this component.

Other features, details, and advantages of the invention ensue from the graphic depiction and subsequent description of preferred embodiments of the pump device according to the invention.

BRIEF DESCRIPTION OF THE DRAWINGS

FIGS. 1*a* to 1*d* show a first embodiment of a pump device comprised of a radial piston pump 2, and a low pressure pump 4 in the form of a gear pump 6, which is connected as a pre-feed pump before the radial piston pump 2. The gear pump 6 is provided with its pump housing 8 on the side remote from the drive end 10 of the radial piston pump 2 resting against an end face 12 of a pump housing 14 of the radial piston pump 2. A centering means 16 in the form of a centering flange 18 protrudes from the end face 12 of the pump housing 14 of the radial piston pump 2. A centering collar 20 of a disk-shaped housing part 22 of the gear pump 6 engages in the centering flange 18. Between the contact faces of the centering flange 18 and the centering collar 20, which are concentric to a drive train 24, an elastomer sealing ring element 26 is provided in an annular groove-shaped recess and seals the gear pump 6 and the radial piston pump 2 in relation to the outside. The centering flange 18 rests with its axial end face 19 against a flat end face section of the disk-shaped housing part 22. The gears 28, 30 that mesh with each other are accommodated disposed non-rotatably on a shaft 32 in the disk-shaped housing part 22 of the gear pump 6, wherein the shaft 32 is supported so that it can rotate in the disk-shaped housing part 22. A c losing plate 34 is tightened in a sealed fashion against the end face of the disk-shaped housing part 22 remote from the radial piston pump 2, with the interposition of an elastomer sealing element 36.

Figure 1C:
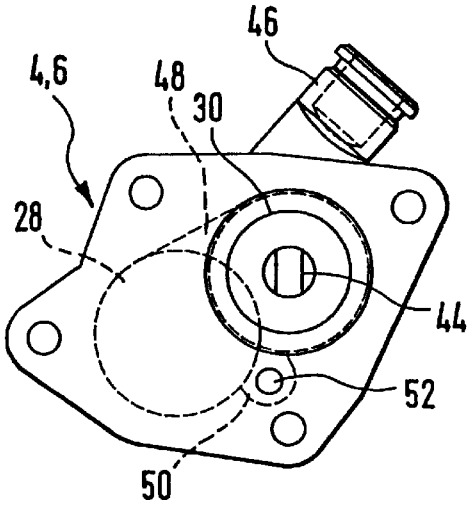
FIGS. 1*a*–1*c* show three different views of a redial piston pump
Figure 1D:
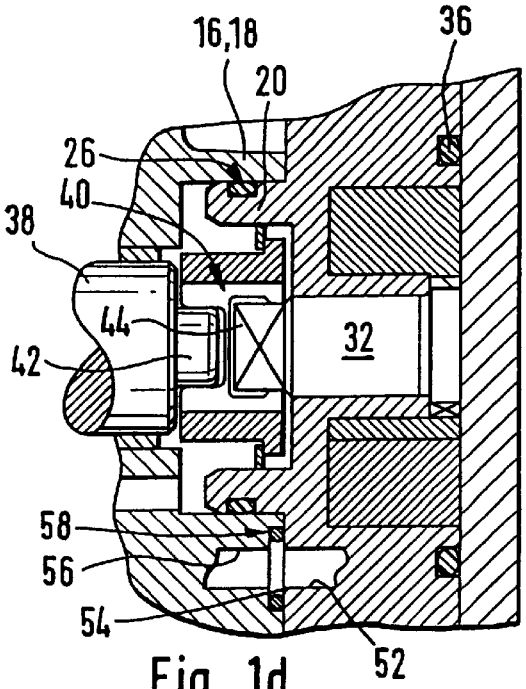
FIG. 1*d* shows a sectional view of a pump device according to the invention.

The shaft 32 of the gear pump 6 is disposed flush with a drive shaft 38 of the radial piston pump 2 and is drive connected to it by way of an Oldham coupling 40, wherein both the drive shaft 38 and the shaft 32 of the gear pump 6 are provided with a pin 42 or 44 oriented toward the coupling.

The supply of fuel to the gear pump 6 takes place by way of a suction fitting 46 to a suction chamber 48, which is constituted by the disk-shaped housing part 22. A bore 52 leads away from a pressure chamber 50 of the gear pump 6, travels parallel to the longitudinal axis of the drive train 24, and feeds into the end face 54 of the disk-shaped housing part 22 that rests against the centering flange 18. The mouth is flush with a fuel supply opening 56 in the pump housing 14 of the radial piston pump 2, which constitutes the intake side of the radial piston pump 2. In the sealing face, an elastomer sealing element 58 is provided around the mouths that are flush with each other.

Figure 1E:
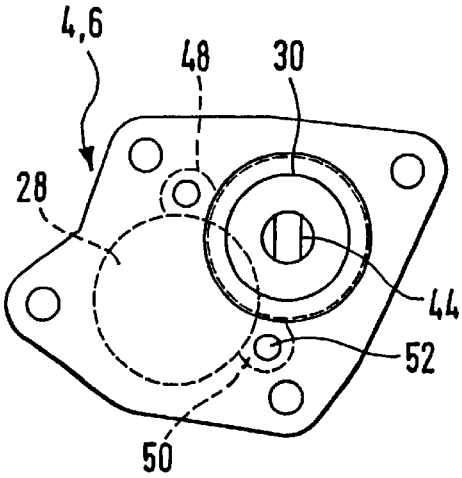
FIGS. 1*e* and *f* show different views that correspond to FIGS. 1*c* and 1*d* with a different fuel supply.
Figure 1F:
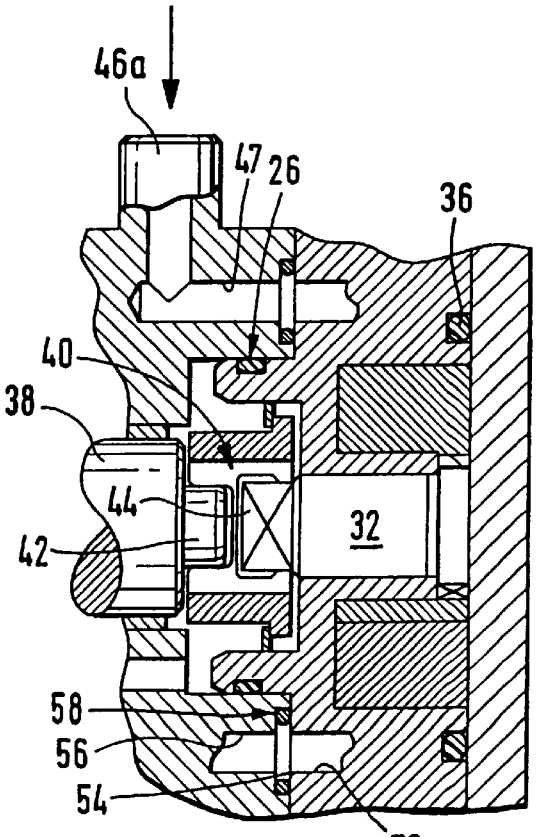

However, the supply of fuel can also take place from the pump housing (monoblock) by way of a bore 47. The intake fitting 46*a* is then disposed on the pump housing; this is shown in FIGS. 1*e* and 1*f*.

The seal in relation to the outside is produced between the gear pump 6 and the radial piston pump 2 by way of the sealing rings 26 and 36. An additional seal in the region of the drive train 24 between the gear pump 6 and the radial piston pump 2 is not required since the internal lubrication of the radial piston pump 2 takes place by means of the supplied medium, fuel. It is therefore harmless if a leak can occur in the region of the drive train 24 from the gear pump 6 into the interior of the radial piston pump 2.

Figure 2:
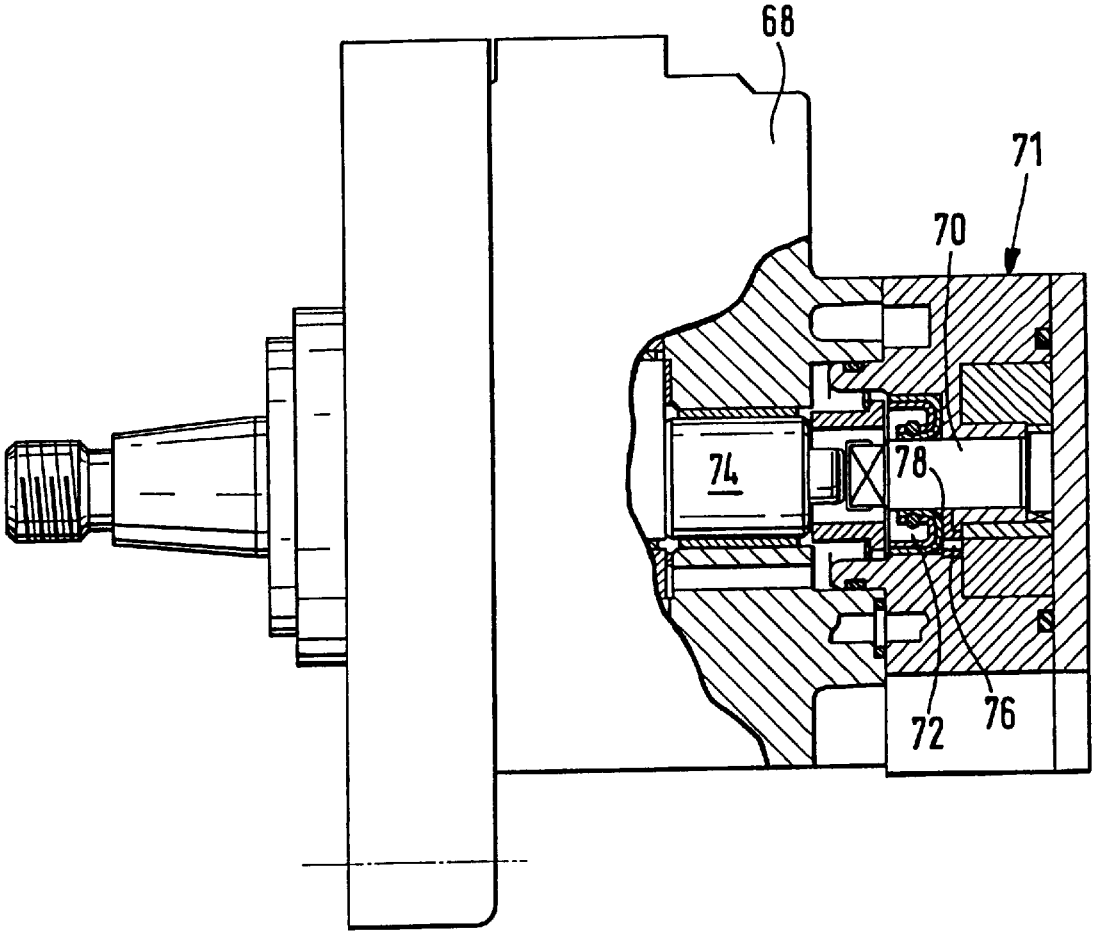
FIG. 2 is a side view, shown partially cut-away in a longitudinal section, of a second exemplary embodiment of the pump device according to the invention.

In contrast to this, in the embodiment according to FIG. 2, the lubrication of the radial piston pump 68 is provided by way of a lubricating circuit, not shown, of the internal combustion engine. Therefore, a sealing element 72 is provided concentric to the shaft 70 of the low pressure pump 71 and prevents a penetration of fuel from the leakage region that is not to be prevented, around the rotatable drive shaft 70 of the low pressure pump 71 into the region of the drive shaft 74 of the radial piston pump 68 that is lubricated by motor oil. In order to return the fuel, a communication opening 76 is provided between a shaft region 78 and the suction chamber of the low pressure pump, which cannot be depicted in FIG. 2.

Figure 3A:
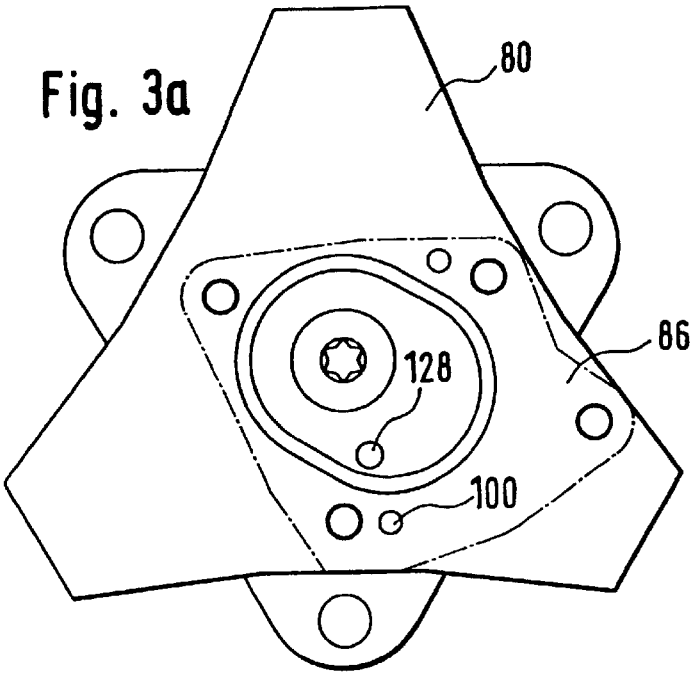
FIGS. 3*a*–3*c* show three different views of a third embodiment
Figure 3B:
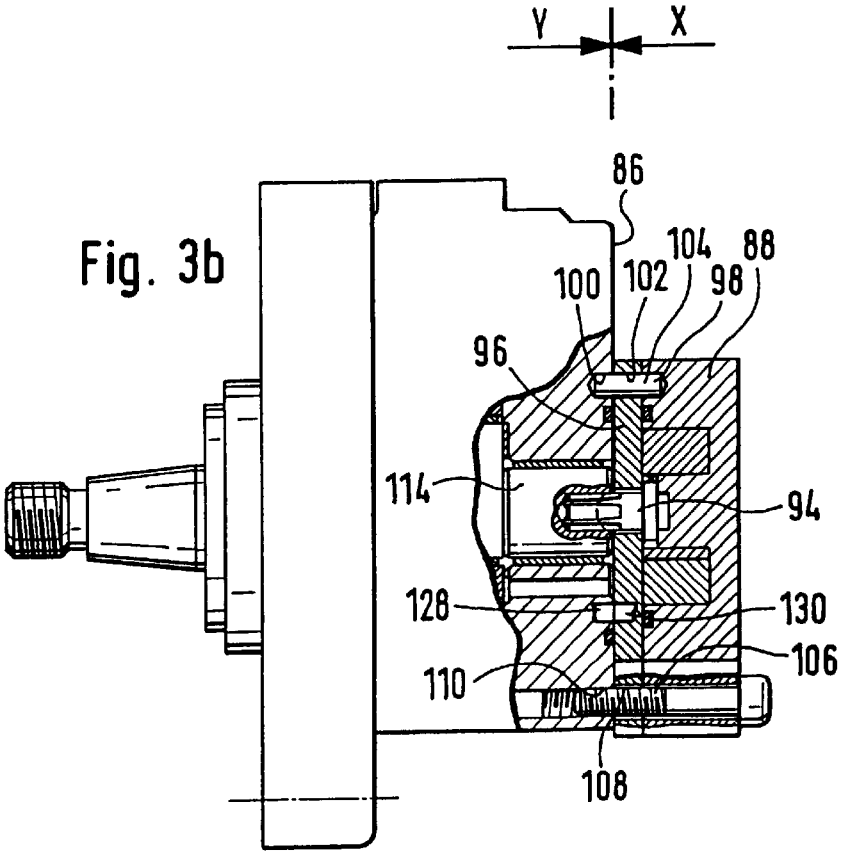
Figure 3C:
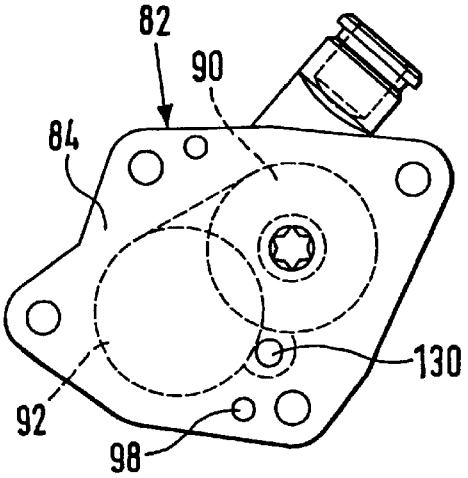
Figure 3D:
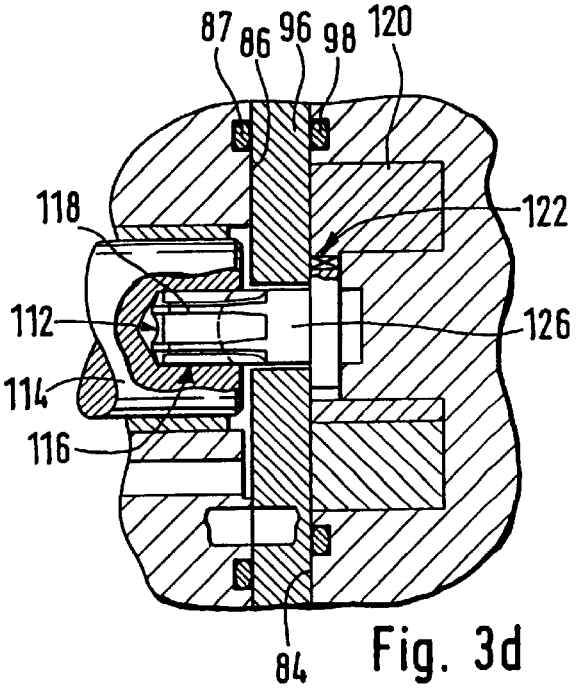
FIG. 3*d* shows a sectional view of a pump device according to the invention in accordance with a third embodiment.
Figure 3E:
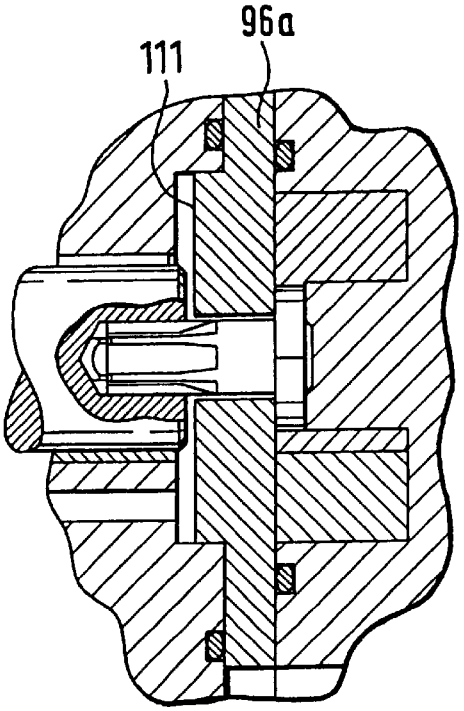
FIGS. 3*e* and *f* show different views that correspond to FIGS. 2*c* and 2*d*, 3*e, f* with slight differences.
Figure 3F:
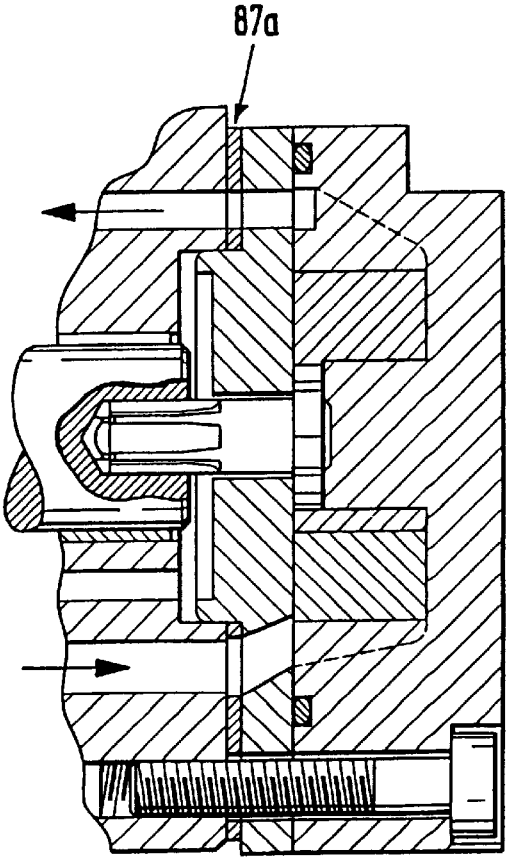

FIGS. 3*a* to 3*f* show another embodiment of a pump device in a very compact design, wherein the radial piston pump 80 is in turn lubricated with fuel. The embodiment to be described below differs from the embodiment according to FIG. 1 by virtue of the fact that the radial piston pump 80 and the gear pump 82 rest against each other by way of flat contact faces 84 and 86. A closed annular groove is provided in the contact surface 86 in order to contain an elastomer sealing element 87. A disk-shaped housing part 88 of the gear pump 82 is thus open toward the contact face 86 of the radial piston pump 80. After the insertion of the gears 90, 92, together with the drive shaft 94, a flange plate 96 is placed against the side of the disk-shaped housing part 88 oriented toward the contact face 86, with the interposition of an elastomer sealing ring 98. The flange plate 96 has through openings 102 that are flush with alignment bores 98, 100, and alignment pins 104 reach through these through openings as centering means. Furthermore, alignment screws 106 are provided, which reach through screw openings 108 in the flange plate 96 and are thus screwed into flush threaded bores 110 in the housing of the radial piston pump 80, by means of which on the one hand, a centering or positioning of the gear pump 82 is achieved and on the other hand, the housing of the gear pump 82 is tightened against the contact face 86 of the radial piston pump 80. According to FIG. 3*e*, however, a centering collar 111 can also be provided on the flange plate 96*a*, which engages in the centering flange of the pump housing. Furthermore, the sealing element 87 can also be embodied as a sealing plate 87*a* (FIG. 3*f*). The driving of the gear pump 83 is in turn carried out by the drive shaft 114 of the radial piston pump 80 via a coupling 112. The drive shaft 114 is embodied with an internal profile 116 that is embodied as a six-pointed star. The coupling 112 has a complementarily embodied opposing profile 118, which produces a positively engaging rotational slaving. On the low pressure pump end, the driven gear 120 is connected to the drive-end coupling part 126 by way of a positively engaging profile 122 that produces a rotational slaving. Flush deviations between the drive shaft 114 and the gear 120 are compensated for by way of the play of the two profile pairings. The conveyance of the fuel takes place in the same manner as in the embodiment according to FIG. 1, by way of supply openings 128 and 130 that are flush with each other. The foregoing relates to preferred exemplary embodiments of the invention, it being understood that other variants and embodiments thereof are possible within the spirit and scope of the invention, the latter being defined by the appended claims.

What is claimed is:

1. A pump device for high-pressure fuel delivery in fuel injection systems of internal combustion engines, in particular in a common rail injection system, including a radial piston pump (2, 68, 80) with a drive shaft (38, 74, 114) that is supported in a pump housing (14) and is embodied eccentrically or has cam-like projections in the circumference direction, preferably with a number of pistons that are each disposed in a cylinder chamber radially in relation to the drive shaft and can be driven to reciprocate in the cylinder chamber when the drive shaft rotates, and with a check valve on the intake side and the high pressure side, and a low pressure pump (4, 71, 82) connected before the radial piston pump, characterized in that the low pressure pump (4, 71, 82) is provided on or in the pump housing (14) of the radial piston pump (2, 68, 80), on the end remote from the drive end (10), and can be driven by the drive shaft (38, 74, 114) of the radial piston pump.

2. The pump device according to claim 1, in which a coupling (40, 112) is interposed between the drive shaft (38, 74, 114) of the radial piston pump and a shaft (32, 70, 94) of the low pressure pump.

3. The pump device according to claim 1, in which the housing (8) of the low pressure pump is mounted to the pump housing (14) of the radial piston pump by away of a centering means (16).

4. The pump device according to claim 2, in which the housing (8) of the low pressure pump is mounted to the pump housing (14) of the radial piston pump by away of a centering means (16).

5. The pump device according to claim 3, in which a centering flange (18), which protrudes toward the housing (8) of the low pressure pump (4), is provided on the pump housing (14) of the radial piston pump (2) and can be used to position the housing of the low pressure pump.

6. The pump device according to claim 4, in which a centering flange (18), which protrudes toward the housing (8) of the low pressure pump (4), is provided on the pump housing (14) of the radial piston pump (2) and can be used to position the housing of the low pressure pump.

7. The pump device according to claim 5, in which an elastomer sealing means(26) for producing a seal in relation to the outside is provided between the centering flange (18) of the radial piston pump (2) and the housing (8) of the low pressure pump (4).

8. The pump device according to claim 6, in which an elastomer sealing means(26) for producing a seal in relation to the outside is provided between the centering flange (18) of the radial piston pump (2) and the housing (8) of the low pressure pump (4).

9. The pump device according to claim 3, in which the centering flange (18) is supported with its end face (19) against a flat end face of the housing (8) of the low pressure pump.

10. The pump device according to claim 5, in which the centering flange (18) is supported with its end face (19) against a flat end face of the housing (8) of the low pressure pump.

11. The pump device according to claim 1, in which the radial piston pump and the high pressure pump rest with flat end faces against each other.

12. The pump device according to claim 2, in which the radial piston pump and the high pressure pump rest with flat end faces against each other.

13. The pump device according to claim 3, in which the radial piston pump and the high pressure pump rest with flat end faces against each other.

14. The pump device according to claim 3, in which the centering means is preferably constituted by a number of alignment bores (98, 100, 102) and alignment pins (104) that engage in them.

15. The pump device according to claim 7, in which the centering means is preferably constituted by a number of alignment bores (98, 100, 102) and alignment pins (104) that engage in them.

16. The pump device according to claim 9, in which the centering means is preferably constituted by a number of alignment bores (98, 100, 102) and alignment pins (104) that engage in them.

17. The pump device according to claim 11, in which the centering means is preferably constituted by a number of alignment bores (98, 100, 102) and alignment pins (104) that engage in them.

18. The pump device according to claims 3, in which the centering means is preferably constituted by a number of threaded bores (110) and alignment screws (106) that are screwed into them.

19. The pump device according to claim 1, in which a fuel supply conduit (52) leads away from a pressure chamber (50) of the low pressure pump (4) and communicates with a fuel supply opening (56) in the pump housing (14) of the radial piston pump (2).

20. The pump device according to claim 1, in which a conduit leads to a suction chamber (48) of the low pressure pump (4) and communicates with a conduit in the pump housing (14) of the radial piston pump (2) from which the fuel is supplied to the intake side of the low pressure pump (4).

21. The pump device according to claim 1, in which the radial piston pump (2, 80) is fuel-lubricated and in the region of the drive train (24), no additional sealing means is provided for preventing leakage from the low pressure pump (4) into the pump housing (14) of the radial piston pump (2).

22. The pump device according to claim 1, in which the radial piston pump (68) is lubricated by a lubricating oil circuit of the engine and that a sealing element (72) is provided concentric to the drive train in order to prevent leakage from the low pressure pump (71) into the pump housing of the radial piston pump (68).

23. The pump device according to claim 22, in which there is a communication between the shaft region (78) and the intake chamber of the low pressure pump (71) in order to drain away leakage liquid.

* * * * *